US006373214B1

(12) United States Patent
Hörmann

(10) Patent No.: US 6,373,214 B1
(45) **Date of Patent: *Apr. 16, 2002**

(54) METHOD AND DEVICE FOR EXERTING A CLOSING FORCE UPON AN ELEMENT THAT HAS BEEN OPENED

(75) Inventor: Michael Hörmann, Halle/Westf. (DE)

(73) Assignee: Marantec Antriebs-und Steuerungstechnik GmbH & Co. Produktions KG, Marienfeld (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/726,577

(22) Filed: Oct. 7, 1996

(30) Foreign Application Priority Data

Oct. 6, 1995 (DE) ..... 195 37 304

(51) Int. Cl.[7] ..... E05F 15/14

(52) U.S. Cl. ..... 318/466; 318/266; 318/286; 49/28; 310/68 E

(58) Field of Search ..... 49/25, 28, 138, 49/139, 26; 318/282, 266, 286, 466; 310/68 E, 68 D, 83

(56) References Cited

U.S. PATENT DOCUMENTS 3,955,661 A * 5/1976 Popper et al. ..... 192/150
4,311,225 A * 1/1982 Tsubaki et al. ..... 192/142 R
4,673,848 A * 6/1987 Hagiwara et al. ..... 318/266
4,952,080 A 8/1990 Boiucaner et al. ..... 388/811
4,999,551 A * 3/1991 Yoshida et al. ..... 318/286
5,222,327 A * 6/1993 Fellows et al. ..... 49/139
5,230,179 A * 7/1993 Richmond et al. ..... 49/28
5,729,101 A * 3/1998 Richmond et al. ..... 318/282

FOREIGN PATENT DOCUMENTS

| | | |
|---|---|---|
| DE | G9202631.1 | 6/1992 |
| DE | 4231984 | 3/1994 |
| DE | 4331781 | 3/1995 |
| DE | 4339565 | 5/1995 |
| DE | 9404330 | 7/1995 |

* cited by examiner

*Primary Examiner*—Karl Tamai
(74) *Attorney, Agent, or Firm*—Dilworth & Barrese

(57) ABSTRACT

The present invention relates to a drive system for closing elements, preferably for doors, roller blinds or windows, with a motor, with a position pick-up to detect certain positions of the closing element, with an operating unit which allows authorized persons to open or close the closing element, and with a control unit with the control unit being actively linked to the motor, the position pick-up and the operating unit. To solve the object of preventing any arbitrary opening in such a drive system without using additional locking elements and without any self-locking effect of the drive system, the motor can be driven by the control unit at times where no command to open exists from the operating unit in such a way that a closing force can be exerted on the closing element which closing force depends on the position and/or change in position of the closing element.

9 Claims, 4 Drawing Sheets

METHOD AND DEVICE FOR EXERTING A CLOSING FORCE UPON AN ELEMENT THAT HAS BEEN OPENED

BACKGROUND OF THE INVENTION

The present invention relates to a drive system for closing elements, preferably for doors, roller blinds or windows.

Driven closing elements offer the advantage that they can be driven using a remote control. In the case of driven garage doors, these can, for example, comfortably be opened or closed from the car by a remote control.

One disadvantage of driven closing elements, however, consists of the fact that as a rule these are only secured against unauthorized opening by the self-locking effect of the drive system. While additional mechanical locking systems such as locks with locking bolts provide sufficient protection in support of the self-locking effect, they do, however, lead to a complicated design and to a complicated handling in the closing and opening of the closing element.

SUMMARY OF THE INVENTION

It is therefore the object of the present invention to provide additional securing measures against unauthorized opening with low design effort for a driven closing element.

This object is solved in accordance with the invention by the features given for a drive system for closing elements, preferably for doors, roller blinds or windows, comprising a motor, a position pick-up to detect certain positions of the closing element, an operating unit which allows authorized persons to open or close the closing element, and a control unit being actively linked to the motor, the position pick-up and the operating unit. The motor driven by the control unit can exert a closing force on the closing element, which force depends on the position and/or the change in position of the closing element.

The solution in accordance with the invention has the effect that when an attempt is made to open the closing element, this is supplied with a closing force as a counter-force.

The advantage of the drive system in accordance with the invention is, in particular, that an additional electronic surveillance of the closing element occurs and that an active closing of the closing element is possible in the event of an attempted break-in. The safety of the driven closing element can thus be effectively increased by simple design measures.

In accordance with its basic construction, the drive system in accordance with the invention requires a motor to drive the closing element, a position pick-up to detect certain positions of the closing element and a control unit which processes the signals of the position pick-up and drives the motor. The motor in question is appropriately an electric motor whose direction of rotation can be switched round and which drives the closing element using a reduction gear and corresponding mechanics. The drive system also possesses a control unit which allows authorized persons to open or to close the closing element. This operating unit can, for example, comprise a switch which is activated by a key or also by a suitable remote control.

In accordance with a preferred embodiment it is provided that the motor does not exert any closing force with a fully closed closing element in order not to put any unnecessary load on the motor. As soon as the closing elements is opened beyond a certain position, however, the maximum closing force is exerted on the closing element by the motor. In this configuration the motor can be driven by a simple switching off or over.

In accordance with a further preferred embodiment it is provided that the closing force is driven in dependence on the change in position of the closing element when the closing element returns to its closing position. In this way, it is no longer the control of the closing force which is of prime significance, but the regulation of the closing speed. Whereas, therefore, the largest possible-closing force should be generated as a counter-force in the case of unauthorized opening, when the closing element is closed a low closing speed should exist in order to thus avoid any damage to the closing element from too strong an impact against the end stops.

The position pick-up can preferably comprise circuit elements which are activated at suitable positions by the closing element. In addition, the position pick-up can comprise an incremental transducer driven by the motor. In conjunction with two circuit elements which detect the end positions of the closing element, the incremental transducer can be used to determine the current position of the closing element within the resolution precision of the impulses emitted. In this way it is possible to predetermine any desired force configurations of the closing force in dependence on the position of the closing element.

In accordance with a further preferred embodiment it is provided that an-alarm system is triggered in the closed state of the closing element when a given position of the closing element is exceeded. Here, it is feasible that an already installed alarm system of a building or one still to be installed can be used so that the drive system transfers a corresponding alarm signal to this alarm system. However, it is also feasible that an alarm system be directly integrated in the drive system so that self-sufficient alarm security of the closing element is given.

Advantageously, the drive system in accordance with the invention can be used for closing elements such as doors, roller blinds or windows with the closing motion being able to comprise, for example, a slide, rotation or swivel motion.

BRIEF DESCRIPTION OF THE DRAWINGS

An overhead garage door was used as an embodiment of the invention described in closer detail below by means of the drawings in which.

Figure 1:
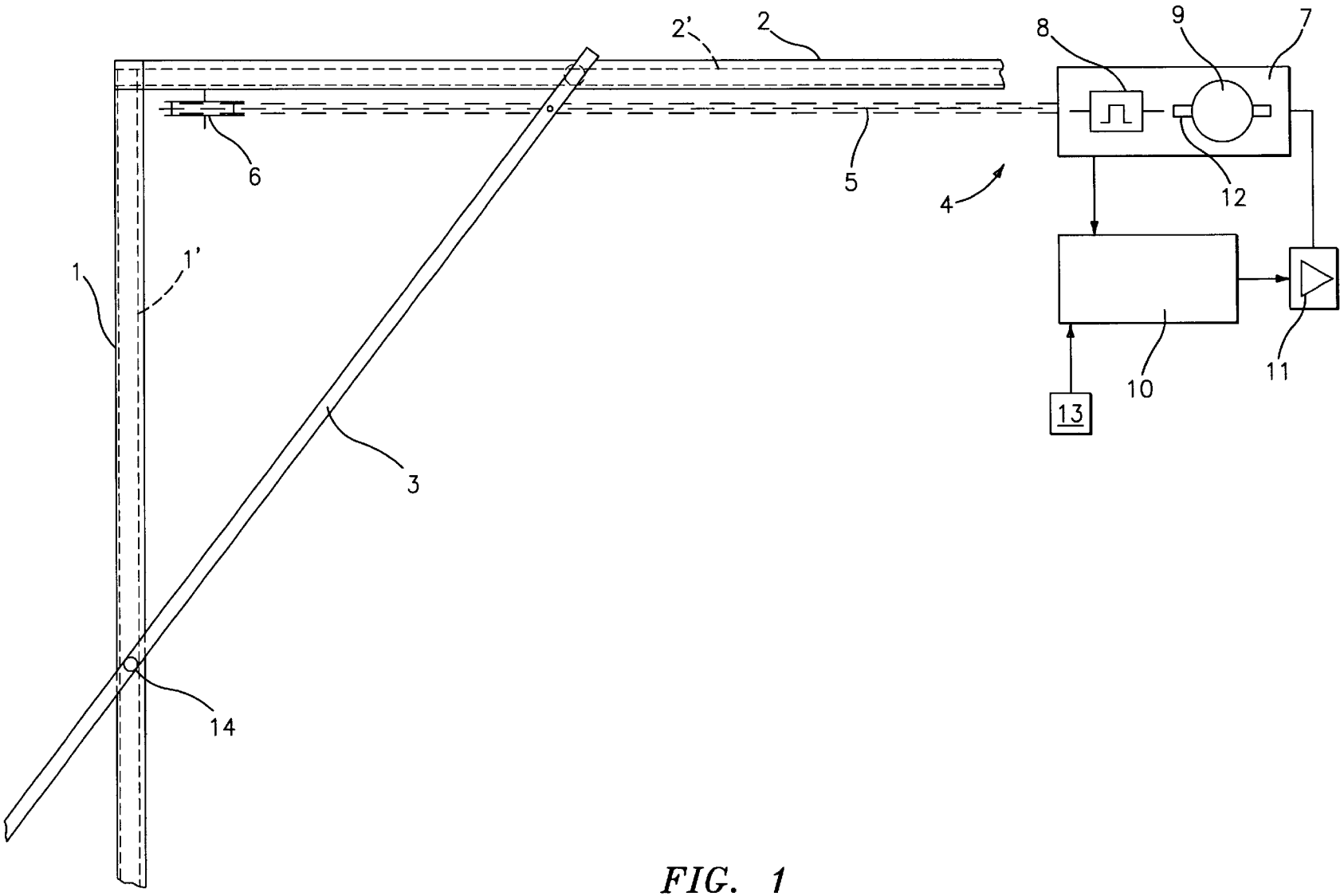
FIG 1 is a schematic representation of a garage door which can be moved overhead with a block diagram of the drive system in accordance with the invention.
Figure 3A:
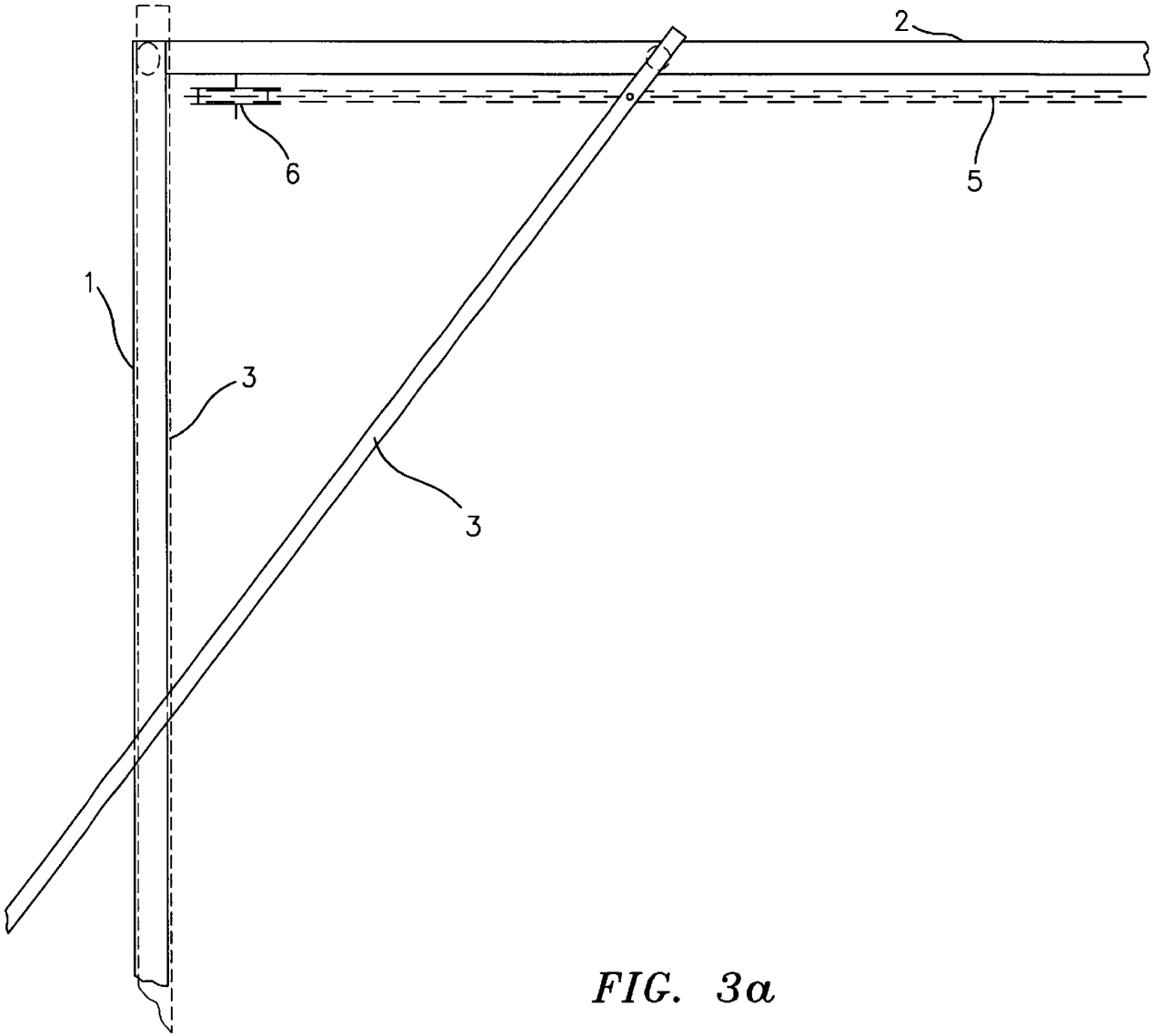
Figure 3B:
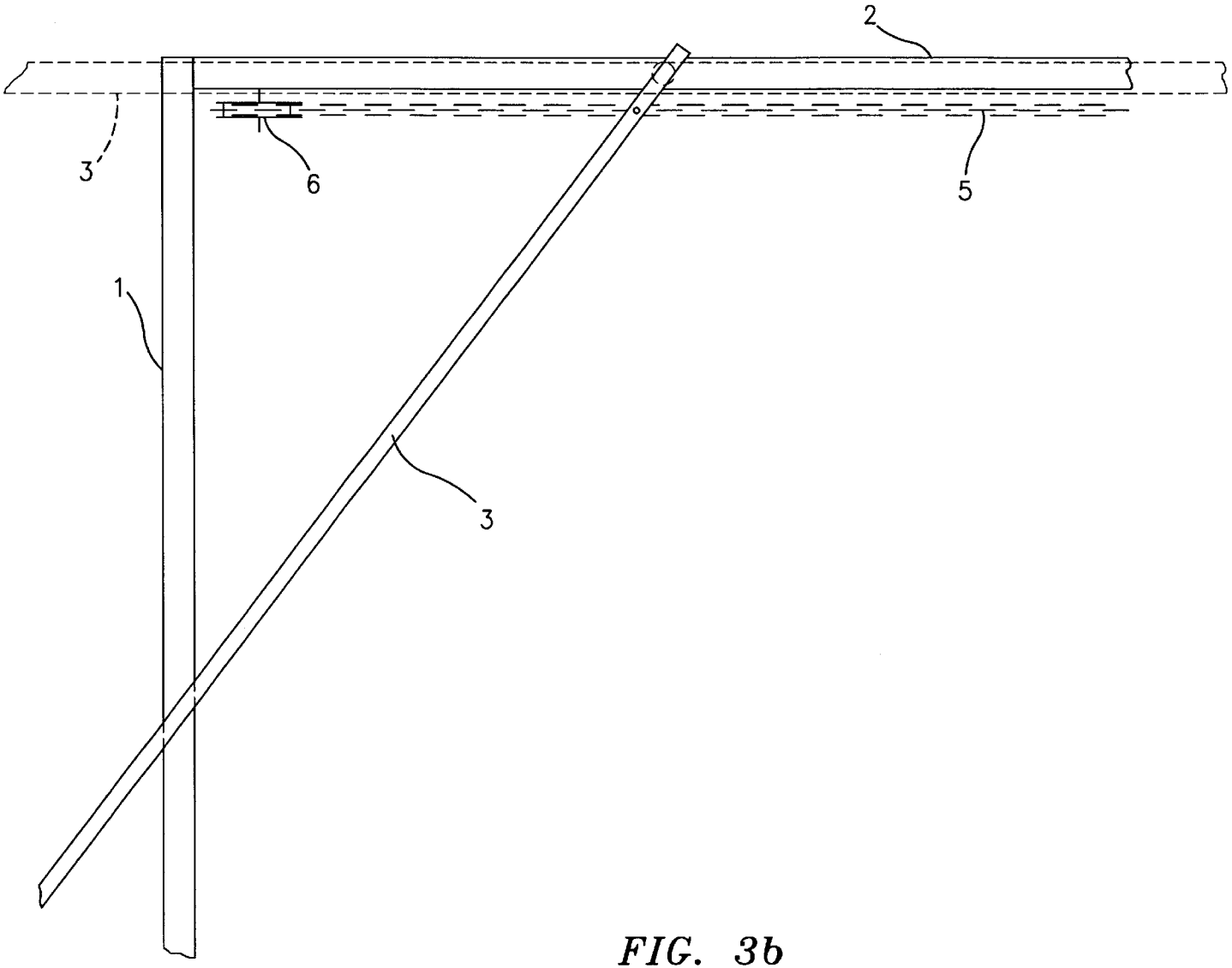

The garage door in FIG. 1 possesses two vertical braces 1 to whose top end two rails 2, 2', (phantom) connect in which the door body 3 is guided. The door body 3 is further hinged to the braces 1, 1', (phantom) with a connecting rod 14 so that the door body can be opened and closed with an overhead movement. In addition, equalizing springs are provided which largely compensate the door body's own weight during the movement and which hold the door body in its defined end positions. The drive system designated with number 4 consists in total of a drag-chain drive with a drag chain 5, to which the door body 3 is hinged and which is guided over the turn pulley 6 and over a drive pulley (not shown). The drive pulley is located in the drive unit 7 and is driven by the electric motor 9 via a reduction gear 12. Also driven by the electrical motor 9 is an incremental transducer 8 which emits an impulse to the control unit 10 after a certain number of rotations. In conjunction with circuit elements which are activated by the door body 3 in its two end positions shown in phantom in FIGS 3*a* and 3*b*, i.e. in the vertical and horizontal positions, the control unit 10 analyzes the impulses of the impulse generator. It is possible to dispense with the incremental transducer if corresponding circuit elements are located in such a way that the control unit receives the required positional information. The output signal of the control unit 10 leads to an amplifier 11 which supplies the required power to the electric motor 9.

Figure 2:
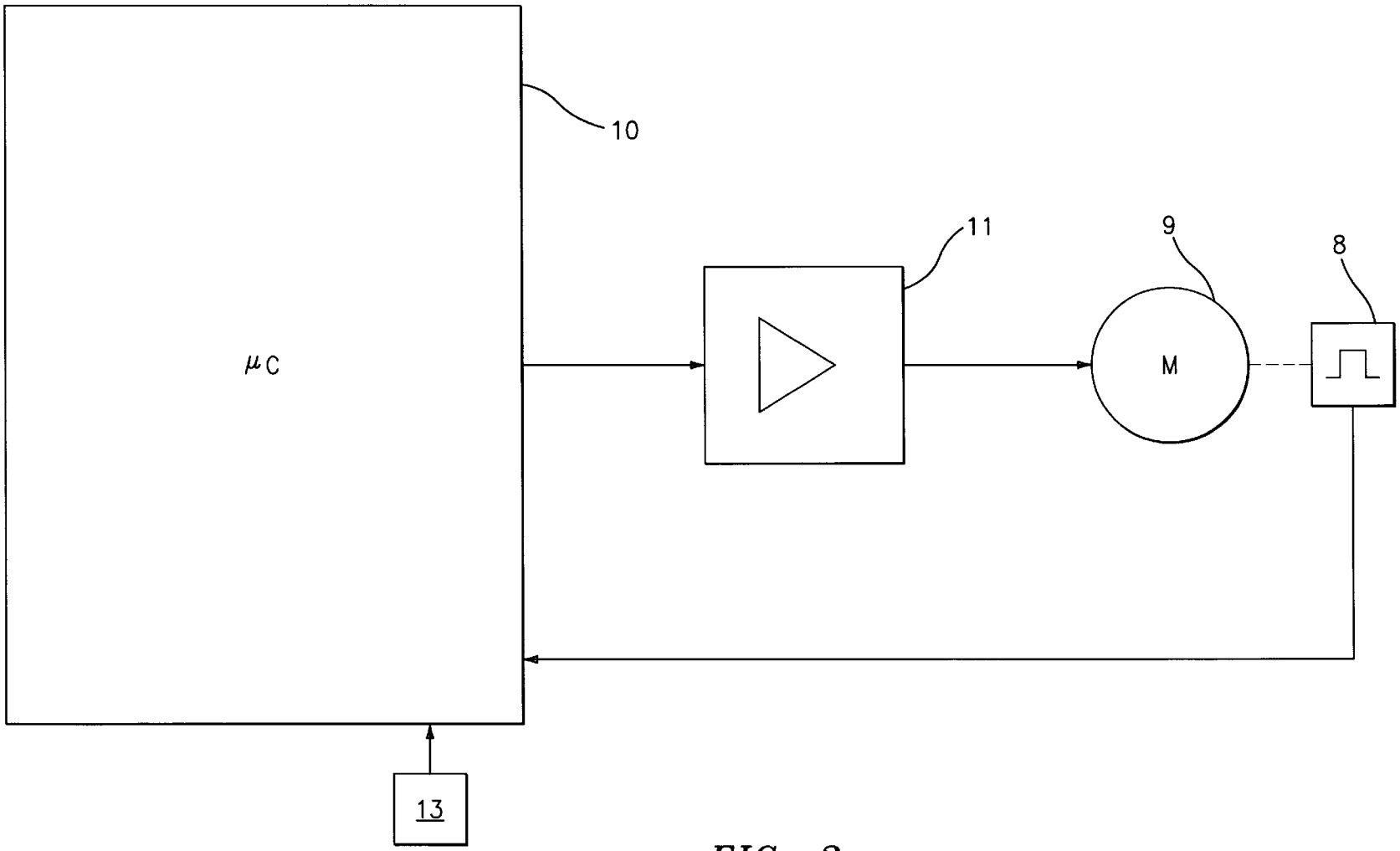
FIG 2 is an exploded block diagram of the drive system in accordance with the invention and FIGS. 3*a* and 3*b* schematically illustrate vertical and horizontal end positions of the garage door.

FIG. 2 shows the electronic components of the drive system. According to this, the control unit 10 comprises a micro-controller MC. In addition to the impulses of the incremental transducer 8 and further circuit elements as given, the micro-controller 10 also evaluates the signal of a receiver unit (not shown in any detail) of a radio remote control with which authorized persons can open or close the garage door.

If a command to open the garage door 3 is received by the micro-controller, then the electric motor 9 is driven via the amplifier 11 in a known manner. When the end position is reached, which is detected by a limit switch or also by corresponding integration of the impulses of the incremental transducer 8, the motor is switched off again. If, in the other case, a command to close the garage door is given to the micro-controller, then the corresponding functional procedure ensues.

The functioning of the drive system in accordance with the invention begins when the garage door is closed. Appropriately, in the fully closed position of the door body no closing force is yet exerted so that the motor is thus not subjected to any unnecessary load. However, as soon as the micro-controller 10 detects via the incremental transducer 8 or also via corresponding position switches a position of the garage door beyond that of a permitted position, the motor is driven in such a way that a closing force is exerted on the garage door. Depending on the type of motor and the driving circuit, the closing force in this operation can vary in dependence on the position or also on the change in position of the garage door.

The simplest possibility comprises the closing force being set to a maximum value corresponding to the maximum stop moment of the motor from a certain position. In this manner, the motor can be driven by a simple switching on or over.

In addition, for the return of the door body into its closing position it can be provided that the closing force as the control value follows a nominal course of the change in position, i.e. the return speed to the stop position In this way, a gentle closing of the door body is effected. This can be particularly necessary when an authorized person first tries to open the door and suddenly releases the door again after activating the maximum closing force. Reference Numeral 13 denotes an integrated alarm system.

What is claimed is:

1. A drive system for a closing element, comprising a motor, a position pick-up to detect certain positions of the closing element, an operating unit which allows authorized persons to open or close the closing element, and a control unit, with the control unit being actively linked to the motor, the position pick-up and the operating unit, and a reduction gear coupled to the motor and closing element such that the motor drives the closing element by means of the reduction gear, wherein the motor driven by the control unit can exert the closing force on the closing element, which force depends on the position and/or the change in position of the closing element, the closing force is not generated when the closing element is fully closed and increases to a maximum value as soon as the closing element is opened beyond a given position, when the closing element returns to fully closed position, the closing force depends upon the change of position of the closing element in such a way to ensure gentle closing of the closing element without damage to the element upon impact when fully closed, such that the largest possible closing force is generated as counter-force upon unauthorized opening and low closing speed is provided to avoid any damage to the closing element upon impacts, and said closing element is an overhead structure mounted to open in a direction opposing gravity and close in a direction with gravity, with said respective end positions being substantially horizontal and vertical, whereby regulation of closing speed becomes prime significance and not control of closing force.

2. A drive system, for a closing element, comprising a motor, a position pick-up to detect certain positions of the closing element, an operating unit which allows authorized persons to open or close the closing element, and control unit, with the control unit being actively linked to the motor, the position pick-up and the operating unit, additionally comprising a reduction gear coupled to the motor and closing elements such that the motor drives the closing element by means of the reduction gear, and wherein the motor driven by the control unit can exert the closing force on the closing element, which force depends on the position and/or the change in position of the closing element, the closing force is not generated when the closing element is fully closed and increases to a maximum value as soon as the closing element is opened beyond a given position, when the closing element returns to fully closed position, the closing force depends upon the change in position of the closing element in such a way to ensure gentle closing of the closing element without damage to the element upon impact when fully closed, such that the largest possible closing force is generated as counter-force upon unauthorized opening and low closing speed is provided to avoid any damage to the closing element upon impact, said closing element is a door, roller blinds or a window and an overhead structure mounted to open in a direction opposing gravity and close in a direction with gravity, with said respective end positions being substantially horizontal and vertical, whereby regulation of closing speed becomes prime significance and not control of closing force.

3. A drive system in accordance with claim 1, additionally comprising:

two substantially vertical braces and two substantially horizontal top end rails, with said closing element mounted to said braces and rails by sliding rolling engagement and to be guided by said rails.

4. A drive system for a closing element, comprising a motor, a position pick-up to detect certain positions of the closing element, an operating unit which allows authorized persons to open or close the closing element, and a control unit, with the control unit being actively linked to the motor, the position pick-up and the operating unit, additionally comprising a reduction gear coupled to the motor and closing element, such that the motor drives the closing element by means of the reduction gear, and wherein the motor driven by the control unit can exert the closing force on the closing element, which force depends on the position and/or the change in position of the closing element, the closing force is not generated when the closing element is fully closed and increases to a maximum value as soon as the closing element is opened beyond a given position, and when the closing element returns to fully closed position, the closing force depends upon the change in position of the closing element in such a way to ensure gentle closing of the closing element without damage to the element upon impact when fully closed, additionally comprising:

two substantially vertical braces and two substantially horizontal top end rails, with said closing element mounted to said braces and rails by sliding/rolling engagement and to be guided by said rails.

5. A drive system in accordance with claim 4, additionally comprising a connecting rod through which said element is mounted to said braces.

6. A drive system in accordance with claim 3, additionally comprising a connecting rod through which said element is mounted to said braces.

7. A drive system in accordance with claim 6, additionally comprising a drag-chain drive coupling said element and reduction gear.

8. A drive system in accordance with claim 5, additionally comprising a drag-chain drive coupling said element and reduction gear.

9. A drive system in accordance with claim 4, wherein said closing element is an overhead structure mounted to open in a direction opposing gravity and close in a direction with gravity, with said respective end positions being substantially horizontal and vertical.

* * * * *